United States Patent [19]

Grüssel et al.

[11] Patent Number: 4,693,093

[45] Date of Patent: Sep. 15, 1987

[54] CAM SYSTEM FOR KNITTING MACHINES

[75] Inventors: Klaus Grüssel, Limbach-Oberfrohna; Andreas Neuer, Karl-Marx-Stadt, both of German Democratic Rep.

[73] Assignee: VEB Kombinat Textima, Karl-Marx-Stadt, German Democratic Rep.

[21] Appl. No.: 880,916

[22] Filed: Jul. 1, 1986

[30] Foreign Application Priority Data

Jul. 1, 1985 [DE] Fed. Rep. of Germany ..... 2780356

[51] Int. Cl.[4] ..... D04B 7/00

[52] U.S. Cl. ..... 66/75.1

[58] Field of Search ..... 66/64, 78, 70, 75.1

[56] References Cited

U.S. PATENT DOCUMENTS 4,154,067 5/1979 Grmmer et al. ..... 66/78
4,470,274 9/1984 Shima et al. ..... 66/78
4,545,219 10/1985 Schmodde ..... 66/70
4,616,488 10/1986 Schmodde ..... 66/70

FOREIGN PATENT DOCUMENTS 2304651 8/1973 Fed. Rep. of Germany .

*Primary Examiner*—Ronald Feldbaum
*Attorney, Agent, or Firm*—Michael J. Striker

[57] ABSTRACT

A cam system for a flat knitting machine having a knitting carriage running in one direction, comprises knitting and loop-transferring cam elements. To expand possibilities of the flat knitting machine of the foregoing type to produce a plurality of specific patterns without changing a needle selection system, an additional needle selection element is provided in the cam system for guiding the selected knitting needles over an upper needle sinker away in the region of a full drive element. Also, an additional pull-off cam element is provided in the cam system for bringing the selected needles to a comb-balancing position.

4 Claims, 3 Drawing Figures

CAM SYSTEM FOR KNITTING MACHINES

BACKGROUND OF THE INVENTION

The present invention relates to a cam system for flat-bed knitting machines provided with a knitting carriage running in one direction, on which the loop transfer cam system and the knitting needles, insertable in the needle bed and provided with expanding springs for the loop transfer without racking of the needle bed, are arranged. The cam system can be modified so as to be applied to the flat-bed knitting machines with carriages movable back and forth and to the circular knitting machines with the rotatable cam cylinder.

It has been known that in the flat-bed knitting machines having knitting carriages running in one direction, the knitting and the loop transfer have been realized by means of an integrated cam system. Thereby the switchable cam is connected to the guide cams for the separation of the needle paths for the loop transfer and the loop acceptance and knitting motion, and an adjustable loop transfer cam and a tuck cam are arranged so that a upper needle clearing cam is connected thereto. A switchable cam is positioned opposite to the upper needle for releasing the knitting needles for the loop transfer or the loop formation, the tuck loop formation and the loop acceptance. Further guide cams and a needle spring cam are connected to a combing element. A needle-selecting system is integrated with the cam system. The cam system further has at the level of guide cams a sinker selection arrangement and a pressure bar or override system. The tuck cam also serves as a loop accepting cam.

The disadvantage of this conventional cam system resides in that, during the loop transfer the knitting can not be performed simultaneously, and it is impossible, in order to obtain certain pattern effect, to press individual loops during the knitting as well as to obtain the loops of larger size in the same knitting row.

A cam system for a knitting machine has been disclosed in DE-OS-No. 2,304,651. The cam track in this system is arranged after the upper needle clearing cam and before the cam for pulling off the needle. The knitting needles containing no threads are pulled off by that needle spring-cam. The knitting needles are connected with a push rod cam. The pulling off of the knitting needles over the cam track is guided by the push rod cam or by the side picker.

As understood this cam system does not provide for the transfer of the loops to the opposite needle bed, whereby a new pattern effect can not be achieved.

SUMMARY OF THE INVENTION

It is an object of the present invention to provide an improved cam system for a knitting machine with the knitting carriage movable in one direction.

It is a further object of the invention to provide a cam system by means of which the production of special patterns would be facilitated and expanded.

Yet another object of the present invention is to provide a cam system formed such that without changing of the existing needle selecting system, selected knitting needles would contain no threads in the driven away position.

These and other objects of the invention are attained by a cam system for knitting machines having a movable carriage comprising a loop transfer cam and loop accepting cam integrated in said system, and a needle selecting system in which knitting needles are selected in accordance with sinkers, wherein the knitting needles are provided with lateral expanding springs for enabling a loop transfer without racking a needle bed; a a needle spring cam; an additional selection element for excluding a thread receiving by the selected knitting needles positioned in a full drive position and for guiding said selected knitting needles over an upper needle sinker away in the region of a upper needle clearing cam; and an additional needle spring cam for bringing said selected knitting needles to a combing position, said additional needle spring-cam being arranged in the direction of moving of the carriage after said aforementioned needle spring cam.

The additional selection cam may be a pressure plate acting on the knitting needles via sinkers or pattern swinging elements.

The additional selection cam may include an electronic adjusting member pressing the selected knitting needles away from the region of the upper needle sinker.

The additional needle spring cam may be formed as a cam track extended parallel to said aforementioned needle spring cam.

The additional needle spring cam may be formed by combing elements, said combing elements reaching the level of said full drive element for receiving the knitting needles lifted by said aforementioned needle spring cam.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
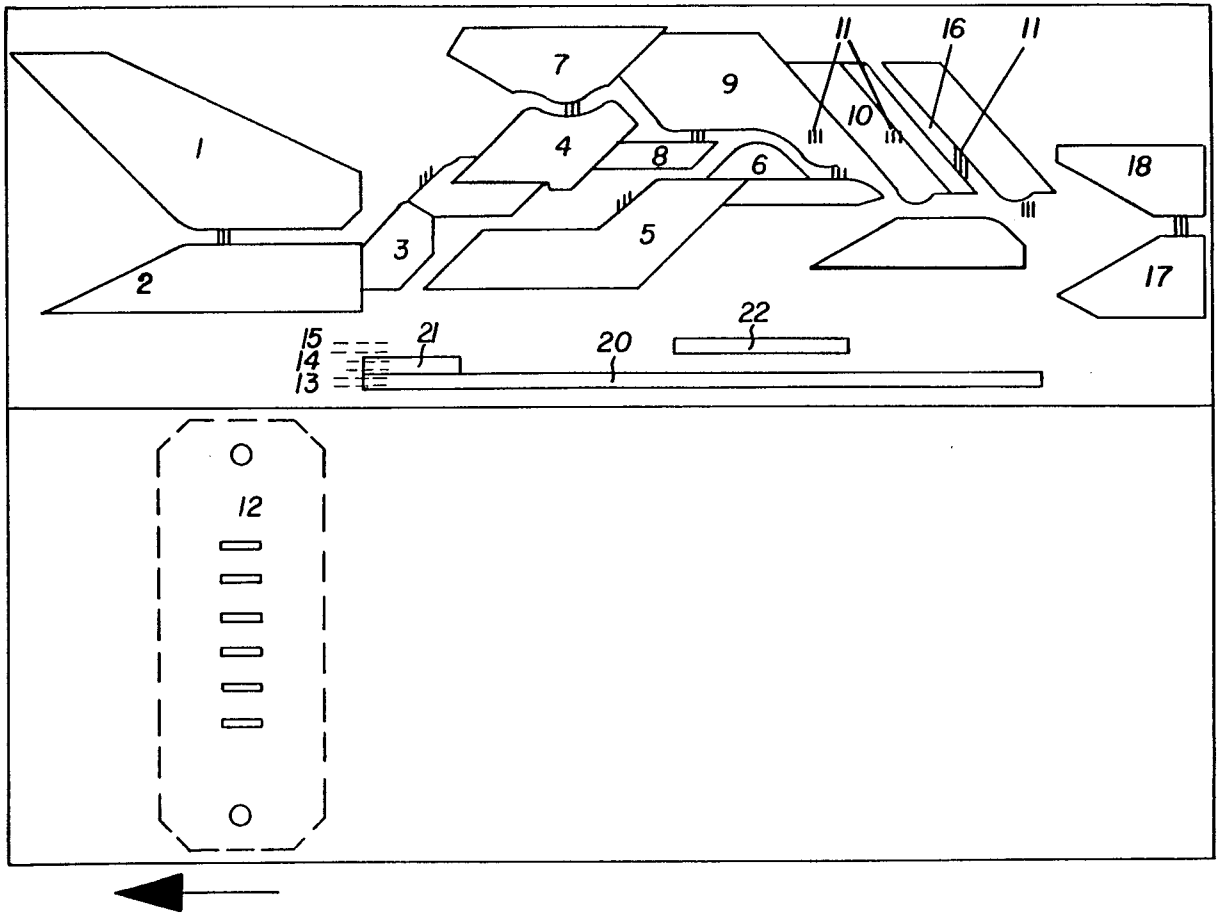
FIG. 1 is a top plan view of the cam system for a needle bed of a flat knitting machine with a knitting carriage running in one direction.

The cam system shown in FIG. 1 is intended only for one needle bed of the knitting machine; a similar cam system is provided for the other needle bed.

The cam system comprises guide cams 1, 2, a deflecting cam 3, an adjustable loop-transferring cam 4, an adjustable tuck cam 5 which, at the same time is formed as a loop-transmitting cam, and an upper needle clearing cam 6. For the loop-transferring cam 4, the tuck cam 5 and the upper needle clearing cam 6, are provided guard cams 7, 8 and 9, whereby the guard cam 9 serves simultaneously as an upper needle sinker for the fully withdrawn knitting needles. The pulling off of the knitting needles is obtained by a needle spring cam 10. At the level of the guide cams 1, 2, is provided a needle selection system 12, the sinkers of which are guided in sinker tracks 13, 14, 15 whereby respective needles are selected.

In the direction of running of the carriage and behind the needle spring cam 10, is positioned a further cam track 16. Combing cams 17, 18 are connected to the cam track 16. In the region of the sinker tracks 13, 14, 15, are positioned presser bars 20, 21, 22.

Figure 3:
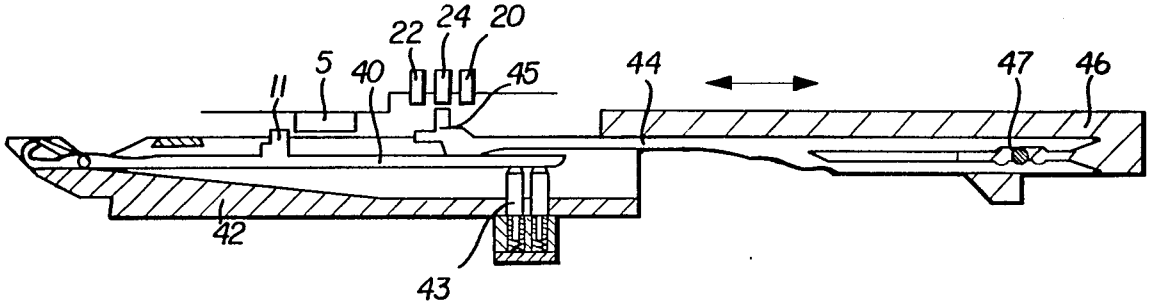
FIG. 3 is a partial sectional view of a conventional needle-and-sinker arrangement of the circular knitting machine.

For the sake of clarity, a conventional arrangement of a needle and a sinker of a knitting machine is illustrated in FIG. 3 which shows a needle bed 42 with a knitting needle 40 having a needle foot 41. The knitting needles 40 are positioned in a needle bed 42. The shaft of each needle is supported on spring pins 43. Sinkers 44 each having a foot 45 lie on the shafts of the needles. Each sinker is at its end opposite to the foot 45 is fork-like and is positioned at said opposite end in a sinker bed 46. Sinker 44 is lockable in its bed in three positions by wires 47.

Presser bars 20–22 shown in FIG. 1 act on feet 45 of sinkers 44 in sinker tracks 13, 14, 15. If a respective presser bar 20, 21, 22 is actuated it will push in a predetermined range the sinker 44 towards the shaft of the knitting needle 40 and will push the foot 11 out of engagement with the cam.

The sinkers in the sinker track 13 are guided via the needle selecting system, the respective knitting needles of which must remain out of operation; the sinkers in the sinker track 14, the respective knitting needles of which form the loops, and the sinkers in the sinker track 15, the respective knitting needles of which, after the adjustment of the deflecting cam 3, must form tuck loops or be in the loop transfer position, are driven away. Needles with lateral expanding springs which permit the loop transfer without replacing the needle bed can serve in principle as the knitting needles.

Figure 2:
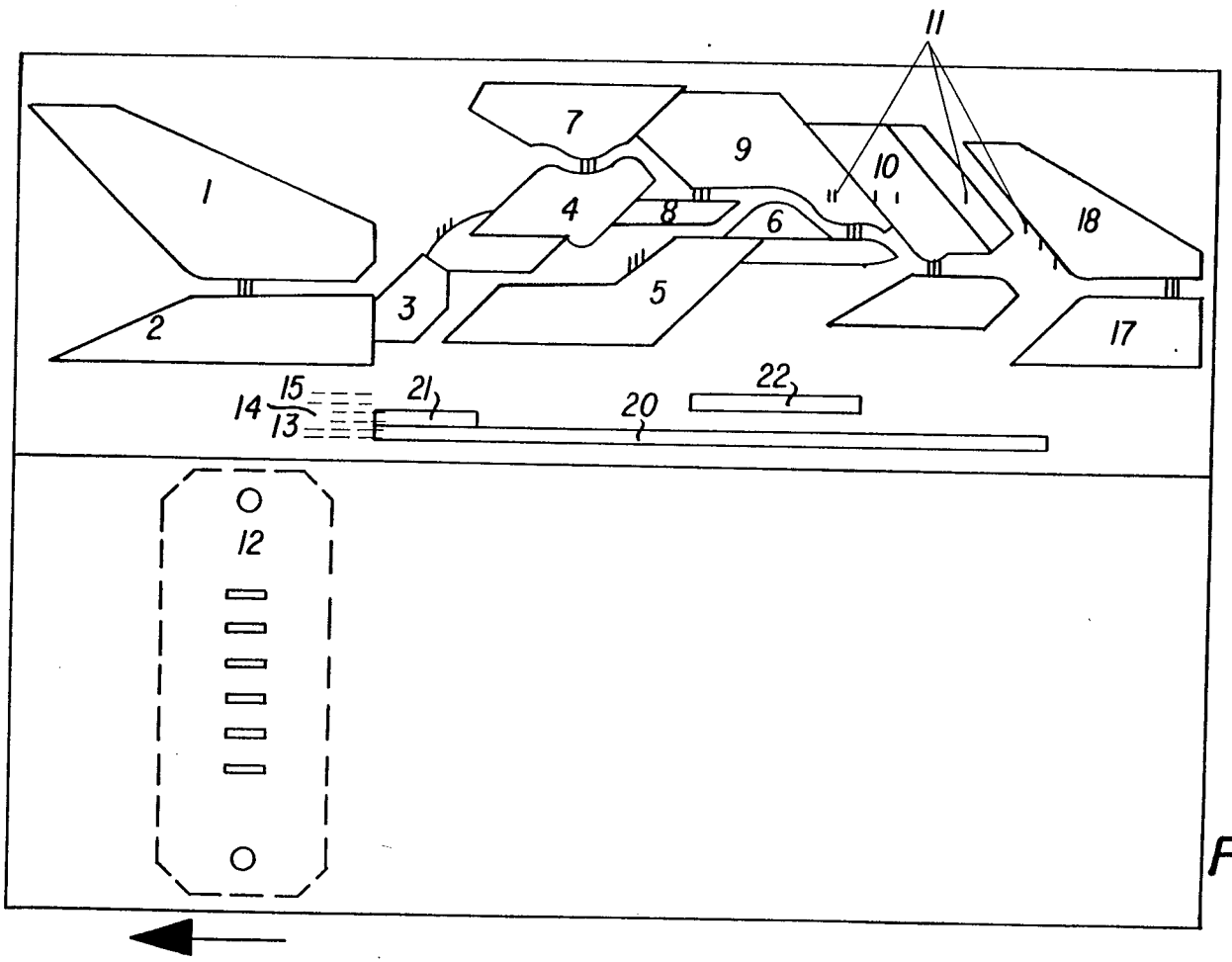
FIG. 2 is a top plan view of the modified embodiment of the cam system.

Instead of the arrangement of a special additional cam track 16 it is also conceivable that the combing cams 17, 18 be formed such that the pull-off of the knitting needles guided by the guard cam 9 and the needle spring cam 10 to the combing position is ensured (FIG. 2). The combing cams 17, 18 which bring the needles to the level of the knock over verge wall of the needle bed reach thereby the level of the upper needle clearing cam 6.

In front of the cam system, the knitting needles are firstly brought to the combing position by the guide cams 1, 2. At the same time, or immediately afterwards, the sinkers and thereby the knitting needles are selected by the needle selecting system 12. Depending on the pattern, the sinkers run in the sinker tracks 13, 14, 15. With the aid of the presser bar 21, the sinkers of the middle sinker track 14 are lifted via the deflecting cam 3, and their respective or assigned knitting needles form loops. The sinkers then are drawn by the needle spring cam 10 and brought through the combing cams 17, 18 to the combing position. The knitting needles of the sinkers positioned in the sinker track 15 arrive at the loop transfer or tucking position in dependence upon the cam 3 and the presser bar 22. The pulling off of the these knitting needles is obtained by the respective guard cams 7, 8, 9 and the the needle spring cam 10 towards the combing cams 17, 18.

If, during the running through the cam system, loops are simultaneously transferred and loops are formed with the cam system, then, upon reaching of the full drive position, the sinkers of the knitting needles, which transfer their loops to the knitting needles of the oppositely-positioned needle bed, are pressed by the presser bar 20 whereby the knitting needles are lifted at their feet 11 over the cams 9 and 10 to be guided through the cam track 16 towards the combing cams 17, 18. The knitting needles driven for the loop formation form their loops in the aforementioned manner and are moved by the needle spring cam 10 to the combing cams 17, 18. The knitting needles lifted at their feet 11 over the cams 9, 10 contain no threads because, during the thread feed, the knitting needles are driven further and the threads come to lie only behind the needle tongues on the needle shafts which, upon a further pulling-off through the cam track channel 16 are pressed off together with the loops being transferred.

This possibility of the loop transfer and loop formation in one row can be modified also for the producing of specific press-off patterns. In constrast to the above described embodiment the knitting needles positioned opposite to the needles transferring the loops would not be driven in such a case.

Finally, a specific pattern effect can be achieved by the formation of loops of various sizes at the selected positions in the row of the needles in a single bed machine. This is eventually obtained by the loop transfer process for selected knitting needles wherein oppositely lying idle knitting needles carrying no loops are driven. The thread loop formed thereby is designated by d. The thread course of the determined adjacent needles for the formation of larger loops becomes available.

In place of the selection of the sinkers and the assigned knitting needles, for guiding the needles to the pull-off and combing position by the presser bar 20, a specific additional selection system for effecting the knitting needles at the full drive position can be arranged in the region of the upper needle clearing cam 6. As such a selection system, can serve specific electronic adjustment members which select from needle to needle and which guide the knitting needles carrying no threads through the guard cam 9 and the needle spring cam 10. The knitting needles can be fed via the loop transfer cam 4 or also through the tuck cam 5 and the upper needle clearing cam 6.

The solutions according to the invention are applicable also to the flat-bed knitting machines with the carriages moving back and forth. For saving the space required for the machine an additional selection cam and an additional needle spring cam are advantageous only for one direction in the cam system although the arrangement operable for two knitting directions is also conceivable.

It will be understood that each of the elements described above, or two or more together, may also find a useful application in other types of cam systems for knitting machines differing from the types described above.

While the invention has been illustrated and described as embodied in a cam system for knitting machines, it is not intended to be limited to the details shown, since various modifications and structural changes may be made without departing in any way from the spirit of the present invention.

Without further analysis, the foregoing will so fully reveal the gist of the present invention that others can, by applying currect knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a cam system for knitting machines having a movable knitting carriage, the system comprising a drive cam, a loop transfer cam and a loop acceptance cam integrated in said system, and a needle selecting system in which knitting needles are selected in accordance with sinkers, wherein the knitting needles are provided with lateral expanding springs for enabling a loop transfer without racking a needle bed; and a needle spring cam (10), the improvement comprising an additional selection cam for excluding a thread acceptance by the selected knitting needles positioned in a full drive position and for guiding said selected knitting needles over an upper needle sinker away in the region of an upper needle clearing cam (6); and an additional needle spring cam for bringing said selected knitting needles to a combing position, said additional needle spring cam being arranged in the direction of moving of the knitting carriage after said aforementioned needle spring cam (10).

2. The cam system as defined in claim 1, wherein said additional selection element is a pressure bar (20) acting on the knitting needles via sinkers.

3. The cam system as defined in claim 1, wherein said additional needle spring cam if formed as a cam track (16) extended parallel to said aforementioned needle spring cam (10).

4. The cam system as defined in claim 1, wherein said additional needle spring cam is formed by combing cams (17, 18), said combing cams reaching the level of said upper needle clearing cam (6) for receiving the knitting needles lifted by said aforementioned needle spring cam (10).

* * * * *